US012138732B2

(12) United States Patent
Jain et al.

(10) Patent No.: US 12,138,732 B2
(45) Date of Patent: Nov. 12, 2024

(54) POLISHING SYSTEM APPARATUS AND METHODS FOR DEFECT REDUCTION AT A SUBSTRATE EDGE

(71) Applicant: Applied Materials, Inc., Santa Clara, CA (US)

(72) Inventors: Asheesh Jain, Livermore, CA (US); Sameer Deshpande, Milpitas, CA (US)

(73) Assignee: APPLIED MATERIALS, INC., Santa Clara, CA (US)

( * ) Notice: Subject to any disclaimer, the term of this patent is extended or adjusted under 35 U.S.C. 154(b) by 315 days.

(21) Appl. No.: 17/121,467

(22) Filed: Dec. 14, 2020

(65) Prior Publication Data

US 2022/0184771 A1 Jun. 16, 2022

(51) Int. Cl.
*B24B 37/04* (2012.01)
*B24B 57/02* (2006.01)

(52) U.S. Cl.
CPC ..... *B24B 37/042* (2013.01); *B24B 57/02* (2013.01)

(58) Field of Classification Search
CPC ..... B24B 37/042; B24B 37/345; B24B 37/30; B24B 37/005; B24B 37/34; B24B 41/005; B24B 57/02
USPC ..... 451/36, 41, 288, 289, 339, 388
See application file for complete search history.

(56) References Cited

U.S. PATENT DOCUMENTS 4,466,852 A 8/1984 Beltz et al.
4,519,846 A 5/1985 Aigo et al.
4,944,119 A 7/1990 Gill, Jr. et al.
5,329,732 A 7/1994 Karlsrud et al.
5,578,529 A * 11/1996 Mullins ..... B08B 3/02 438/692
5,738,574 A 4/1998 Tolles et al.
5,762,543 A 6/1998 Kasprzyk et al.
5,934,984 A 8/1999 Togawa et al.
5,947,802 A 9/1999 Zhang et al.
6,050,884 A 4/2000 Togawa et al.
6,074,275 A 6/2000 Yashiki et al.
6,102,777 A 8/2000 Duescher et al.
6,131,589 A 10/2000 Vogtmann et al.
6,196,896 B1 3/2001 Sommer
6,358,121 B1 3/2002 Zuniga
(Continued)

FOREIGN PATENT DOCUMENTS

CN 1539161 A 10/2004
CN 1319131 C 5/2007
(Continued)

OTHER PUBLICATIONS

International Search Report dated Feb. 17, 2022 for Application No. PCT/US2021/057087.
(Continued)

*Primary Examiner* — Robert F Neibaur
(74) *Attorney, Agent, or Firm* — Patterson + Sheridan, LLP

(57) ABSTRACT

Embodiments herein include carrier loading stations and methods related thereto which may be used to beneficially remove nano-scale and/or micron-scale particles adhered to a bevel edge of a substrate before polishing of the substrate. By removing such contaminates, e.g., loosely adhered particles of dielectric material, from the bevel edge, contamination of the polishing interface can be avoided thus preventing and/or substantially reducing scratch related defectivity associated therewith.

17 Claims, 8 Drawing Sheets

(56) References Cited

U.S. PATENT DOCUMENTS

| | | | |
|---|---|---|---|
| 6,361,648 | B1 | 3/2002 | Tobin |
| 6,402,598 | B1 | 6/2002 | Ahn et al. |
| 6,537,143 | B1 | 3/2003 | Yang et al. |
| 6,629,883 | B2 | 10/2003 | Katsuoka et al. |
| 6,716,086 | B1 | 4/2004 | Tobin |
| 6,872,129 | B2 | 3/2005 | Tobin |
| 6,968,772 | B2 | 11/2005 | Lin et al. |
| 7,044,832 | B2 | 5/2006 | Yilmaz et al. |
| 7,101,253 | B2 | 9/2006 | Olgado |
| 7,255,771 | B2 | 8/2007 | Chen et al. |
| 7,909,677 | B2 | 3/2011 | Yang et al. |
| 9,013,176 | B2 | 4/2015 | Lischka et al. |
| 9,105,516 | B2 | 8/2015 | Nakamura |
| 9,308,621 | B2 | 4/2016 | Fukushima et al. |
| 10,265,828 | B2 * | 4/2019 | Chen ..... B24B 37/005 |
| 10,442,056 | B2 | 10/2019 | Namiki et al. |
| 11,027,394 | B2 * | 6/2021 | Yang ..... H01L 21/6719 |
| 2001/0005665 | A1 | 6/2001 | Hempel et al. |
| 2003/0003848 | A1 | 1/2003 | Tobin |
| 2004/0127142 | A1 | 7/2004 | Olgado |
| 2005/0176349 | A1 | 8/2005 | Yilmaz et al. |
| 2005/0227595 | A1 | 10/2005 | Marquardt et al. |
| 2005/0274393 | A1 | 12/2005 | Perng et al. |
| 2007/0123047 | A1 | 5/2007 | Shirasu et al. |
| 2007/0218817 | A1 | 9/2007 | Lee |
| 2007/0281589 | A1 | 12/2007 | Oh et al. |
| 2008/0119122 | A1 | 5/2008 | Zuniga et al. |
| 2008/0227374 | A1 | 9/2008 | Schmidt et al. |
| 2008/0268753 | A1 | 10/2008 | Ishikawa et al. |
| 2008/0287044 | A1 | 11/2008 | Yang et al. |
| 2009/0041563 | A1 | 2/2009 | Takahashi et al. |
| 2009/0264056 | A1 | 10/2009 | Chen et al. |
| 2010/0130102 | A1 | 5/2010 | Lischka et al. |
| 2011/0076129 | A1 | 3/2011 | Yang et al. |
| 2012/0021671 | A1 | 1/2012 | McReynolds et al. |
| 2013/0095734 | A1 * | 4/2013 | Zaruba ..... B24B 55/03 451/449 |
| 2013/0115862 | A1 | 5/2013 | Rangarajan et al. |
| 2013/0203321 | A1 | 8/2013 | Chen et al. |
| 2014/0080385 | A1 | 3/2014 | Umemoto et al. |
| 2014/0323017 | A1 | 10/2014 | Tang et al. |
| 2017/0266778 | A1 | 9/2017 | Kamata |
| 2018/0036864 | A1 | 2/2018 | Kawasaki |
| 2020/0376522 | A1 * | 12/2020 | Wu ..... B08B 1/10 |
| 2020/0376523 | A1 * | 12/2020 | Wu ..... H01L 21/67051 |
| 2020/0406310 | A1 * | 12/2020 | Soundararajan ..... F22B 1/284 |

FOREIGN PATENT DOCUMENTS

| | | | |
|---|---|---|---|
| JP | 2003071709 | A | 3/2003 |
| JP | 4065650 | B2 | 3/2008 |
| JP | 2014017428 | A | 1/2014 |
| JP | 2015196211 | A | 11/2015 |
| KR | 100655284 | B1 | 12/2006 |
| KR | 20190070532 | A | 6/2019 |
| TW | I623384 | B | 5/2018 |
| TW | 201938321 | A | 10/2019 |
| TW | 202006857 | A | 2/2020 |
| WO | 2020/100609 | A1 | 5/2020 |

OTHER PUBLICATIONS

TW Office Action dated Aug. 21, 2023 for Application No. TW110145004.

Taiwan Office Action dated Feb. 23, 2024 for Application No. 110145004.

Korean Office Action dated Apr. 26, 2024 for Application No. 10-2023-7001285.

Japanese Office Action dated Jul. 9, 2024 for Application No. 2023-535826.

* cited by examiner

POLISHING SYSTEM APPARATUS AND METHODS FOR DEFECT REDUCTION AT A SUBSTRATE EDGE

BACKGROUND

Field

Embodiments herein generally relate to electronic device manufacturing, and in particular, to chemical mechanical polishing (CMP) systems and methods used in a semiconductor device manufacturing process.

Description of the Related Art

Chemical mechanical polishing (CMP) is commonly used in the manufacturing of high-density integrated circuits to planarize or polish a layer of material deposited on a substrate. One common application of a CMP process in semiconductor device manufacturing is planarization of a bulk film, for example pre-metal dielectric (PMD) or interlayer dielectric (ILD) polishing, where underlying two or three-dimensional features create recesses and protrusions in the surface of the to be planarized material surface. Other common applications include shallow trench isolation (STI) and interlayer metal interconnect formation, where the CMP process is used to remove the via, contact or trench fill material (overburden) from the exposed surface (field) of the layer of material having the STI or metal interconnect features disposed therein.

In a typical CMP process, a polishing pad is mounted to a rotatable polishing platen and a material surface of a substrate is urged against the polishing pad using a rotatable substrate carrier in the presence of a polishing fluid. Material is removed across the surface of the substrate in contact with the polishing pad through a combination of chemical and mechanical activity. The chemical and mechanical activity is provided by the polishing fluid, a relative motion of the substrate and the polishing pad, and the downforce exerted on the substrate against the polishing pad.

Unfortunately, undesirable contaminants introduced between the surface of the substrate and the polishing pad, i.e., the polishing interface, can cause undesirable scratches in the substrate surface. One source of undesirable contaminants at the polishing interface are particles, such as dielectric material flakes introduced in upstream manufacturing processes, that are loosely adhered to the surfaces of the bevel edge of a to-be-polished substrate. During substrate polishing these material flakes transfer from the bevel edge of the substrate to the polishing interface where they cause nano-scratches and/or micro-scratches to the substrate surface.

Unlike other types of defectivity, such as post-CMP residues, scratches cause permanent damage to the substrate surface and cannot be removed in a subsequent cleaning process. For example, even a light scratch that extends across multiple lines of metal interconnects can smear traces of the metallic ions disposed therein across the material layer being planarized and thereby induce leakage current and time-dependent dielectric break down in a resulting semiconductor device, thus affecting the reliability of the resulting device. More severe scratches can cause adjacent metal to undesirably twist and bridge together and/or cause disruptions and missing patterns in the substrate surface, which undesirably results in short circuits, and ultimately, device failure thus suppressing the yield of usable devices formed on the substrate. Similarly, scratches caused during STI CMP can affect gate oxide integrity causing the breakdown thereof and ultimately degrading device performance, reliability, and and/or suppressing yield.

Accordingly, there is a need in the art for systems and methods that solve the above described problems.

SUMMARY

Embodiments herein provide for carrier loading stations and methods which may be used to beneficially remove nano-scale and/or micron-scale particles adhered to a bevel edge of a substrate before polishing of the substrate. By removing such contaminates, e.g., loosely adhered particles of dielectric material, from the bevel edge, contamination of the polishing interface can be avoided thus preventing, and/or substantially reducing, scratch related defectivity associated therewith.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only exemplary embodiments and are therefore not to be considered limiting of its scope, and the disclosure may admit to other equally effective embodiments.

Figure 1A:
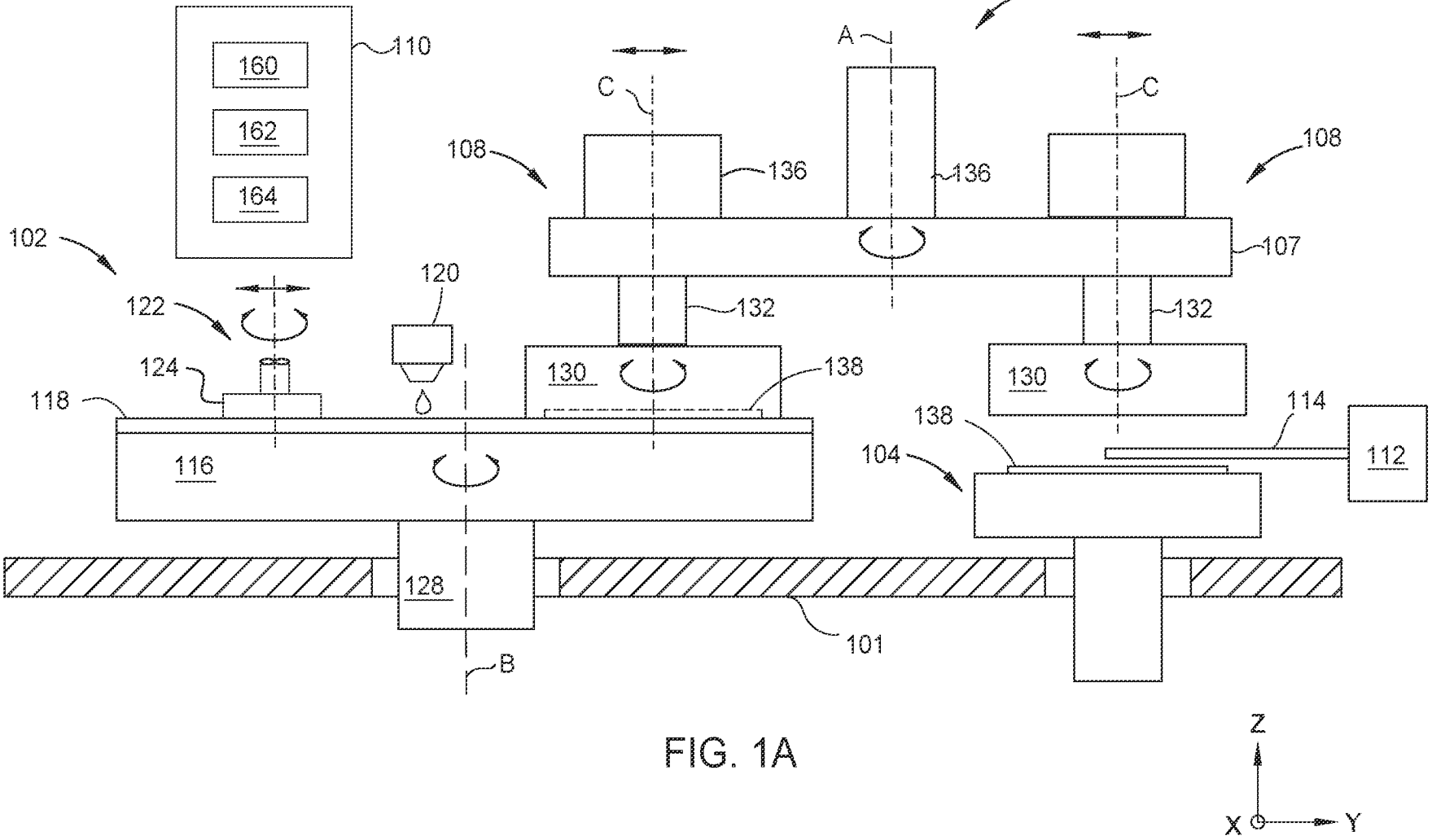
FIG. 1A is a schematic side view of an exemplary polishing system configured to perform the methods set forth herein.

To facilitate understanding, identical reference numerals have been used, where possible, to designate identical elements that are common to the figures. It is contemplated that elements and features of one implementation may be beneficially incorporated in other implementations without further recitation.

DETAILED DESCRIPTION

Embodiments herein generally relate to chemical mechanical polishing (CMP) systems, and in particular, to head clean load/unload (HCLU) stations, herein carrier loading stations, used with CMP systems and methods related thereto. The carrier loading stations and methods may be used to beneficially remove nano-scale and/or micron-scale particles adhered to a bevel edge of a substrate before polishing of the substrate. By removing such contaminates, e.g., loosely adhered particles of dielectric material, from the bevel edge, contamination of the polishing interface can be avoided thus preventing and/or substantially reducing scratch related defectivity associated therewith.

FIG. 1A is a schematic side view of an exemplary polishing system 100 which may be used to perform the methods set forth herein. Here, the polishing system 100 includes a base 101, a plurality of polishing stations 102 (one shown), a loading station 104, a carrier transport system 106, a plurality of carrier assemblies 108, and a system controller 110.

The loading station 104 is used to receive substrates from a substrate handler 112, e.g., a robot having an end effector 114, and return substrates back thereto and to load and unload substrates to and from individual ones of the carrier assemblies 108. Exemplary loading stations 200, 300 which may be used as the loading station 104 are further described in FIGS. 2A-2B and 3A-3B, respectively. The carrier transport system 106 may comprise any suitable system for supporting the plurality of carrier assemblies 108 and to moving the carrier assemblies 108 between the loading station 104 and one or more of the plurality of polishing stations 102 for substrate processing thereon. Here, the carrier transport system 106 is shown as a pivot module which moves the plurality of carrier assemblies 108 between the polishing station 102 and the loading station 104 by pivoting a support arm 107 about an axis A.

The polishing station 102 includes a platen 116 having a polishing pad 118 mounted thereon, a fluid delivery arm 120, and a pad conditioner assembly 122. The platen 116 is rotatable about an axis B using an actuator 128 coupled thereto. The fluid delivery arm 120 is positioned over the platen 116 and is used to deliver a polishing fluid, such as a polishing slurry having abrasives suspended therein, to a surface of the polishing pad 118. Typically, the polishing fluid contains a pH adjuster and other chemically active components, such as an oxidizing agent, to enable chemical mechanical polishing of the material surface of the substrate. The pad conditioner assembly 122 is used urge a fixed abrasive conditioning disk 124 against the polishing pad 118 before, after, or during polishing of a substrate in order to abrade, rejuvenate, and remove polish byproducts from, the surface of the polishing pad 118.

The carrier assemblies 108 are used to transport substrates to and from individual ones of the plurality of polishing stations 102 and therebetween and to urge the substrates against the rotating polishing pads in the presence of the polishing fluid. Here, each of the carrier assemblies 108 includes a carrier head 130 (further described in FIGS. 1A-1B), a carrier shaft 132 coupled to the carrier head 130, and one or more actuators 136 coupled to the carrier shaft 132. The one or more actuators 136 are used to rotate the carrier head 130 about a carrier axis C, and to sweep the carrier head 130 between an inner radius and an outer radius of the polishing pad 118 while the carrier head 130 simultaneously exerts a force against a backside (non-active) surface of a substrate 138 disposed therein.

Figure 1B:
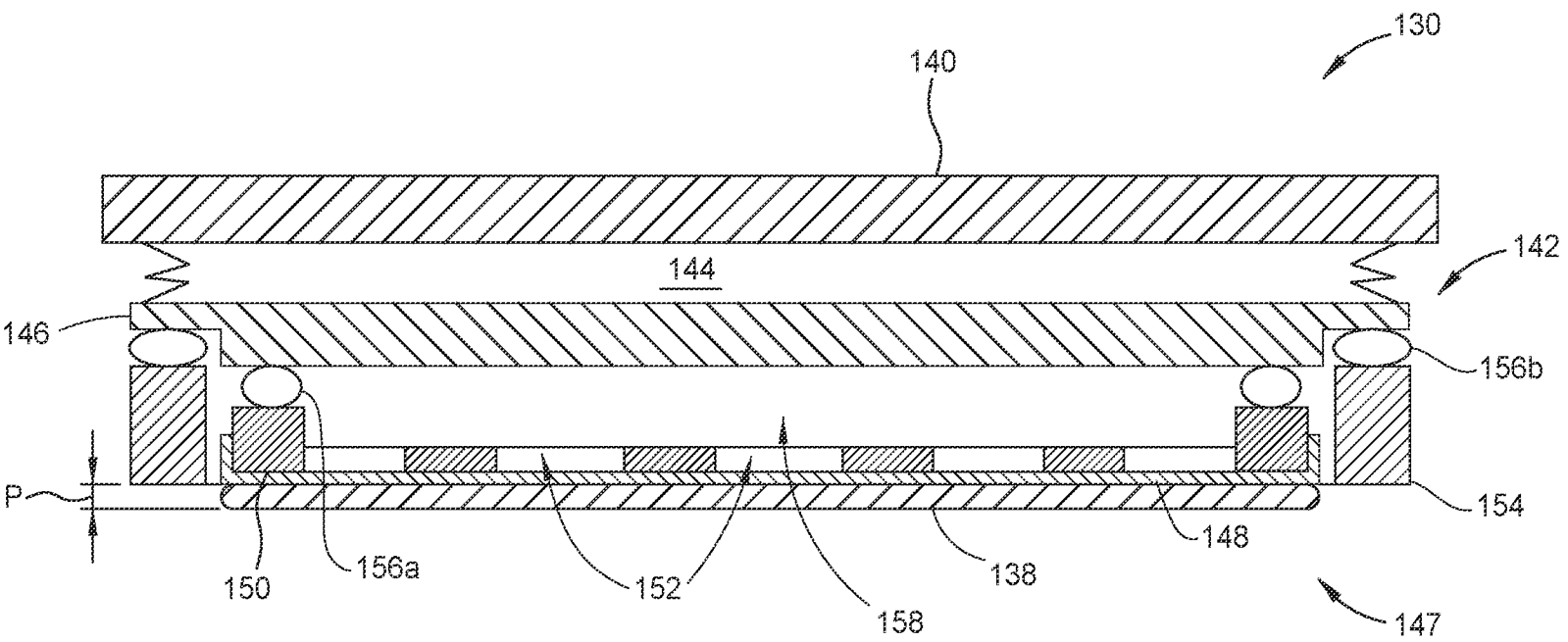
FIG. 1B is a schematic cross sectional view of a substrate carrier of the polishing system shown in FIG. 1A.

An exemplary carrier head 130 is schematically illustrated in cross section in FIG. 1B. In FIG. 1B the carrier head 130 is shown in a loading mode where the substrate 138 is vacuum chucked thereinto. Here, the carrier head 130 includes a housing 140 and a base assembly 142 which is movably and sealingly coupled to the housing 140 to define a load chamber 144 therewith. The downforce exerted on the base assembly 142 and the relative positions of the housing 140 and the base assembly 142 are controlled by pressurizing the load chamber 144 or evacuating gases therefrom, e.g., by applying a vacuum to the load chamber 144.

The base assembly 142 includes a carrier base 146, a substrate backing assembly 147 movably and sealingly coupled to the carrier base 146 to collectively define a chamber 158 therewith, and an annular retaining ring 154 surrounding the substrate backing assembly 147 and movably coupled to the carrier base 146. The substrate backing assembly 147 includes a flexible membrane 148 and a membrane backing plate 150 having a plurality of apertures 152 formed therethrough. The membrane backing plate 150 is sealingly coupled to the carrier base 146 by a first actuator 156*a*, e.g., an annular membrane or bladder, disposed therebetween and the flexible membrane 148 is coupled to the membrane backing plate 150. During substrate polishing, the chamber 158 is pressurized so that the flexible membrane 148 exerts a downward force against the backside surface of the substrate 138 as the carrier head 130 rotates to urge the substrate 138 against the polishing pad 118.

When polishing is complete, or during substrate loading operations, the substrate 138 is chucked to the carrier head 130 by applying a vacuum to the chamber 158 to cause an upward deflection of the surface of the flexible membrane 148 in contact with the backside of the substrate 138. The upward deflection of the flexible membrane 148 creates a low pressure pocket between the flexible membrane 148 and the substrate 138, thus vacuum chucking the substrate to the carrier head 130. The membrane backing plate 150 provides rigid support for the substrate 138 to limit the upward motion of the flexible membrane 148 and the substrate 138 during vacuum chucking and to maintain the shape of the flexible membrane 148.

The retaining ring 154 is coupled to the carrier base 146 using a second actuator 156*b*, e.g., an annular flexible membrane or bladder. During substrate polishing, the retaining ring 154 surrounds the substrate 138 and a downward force on the retaining ring 154 prevents the substrate 138 from slipping from the carrier head 130 as the polishing pad 118 moves therebeneath. The downward forces exerted on the retaining ring 154 and the substrate 138 are independently controlled to allow for fine tuning of polishing conditions at the substrate edge. Similarly, the relative positions of the retaining ring 154 and the membrane backing plate 150, e.g., the offset in the Z-direction therebetween, may be independently controlled using the respective actuators 156*a,b* coupled thereto. This controllable offset determines the amount of recess and/or protrusion P of the substrate 138 relative to the retaining ring 154 when the substrate 138 is vacuumed to the carrier head 130. In some embodiments, the controllable recess or protrusion P of the substrate 138 relative to the retaining ring 154 is advantageously used to facilitate cleaning of the bevel surface of the substrate 138 as described in the methods below.

Operation of the polishing system 100 is facilitated by the system controller 110 (FIG. 1A). The system controller 110 includes a programmable central processing unit (CPU) 160, which is operable with a memory 162 (e.g., non-volatile memory) and support circuits 164. The support circuits 164 are conventionally coupled to the CPU 160 and comprise cache, clock circuits, input/output subsystems, power supplies, and the like, and combinations thereof coupled to the various components of the polishing system 100, to facilitate control of substrate processing operations therewith.

The CPU 160 is one of any form of general purpose computer processor used in an industrial setting, such as a programmable logic controller (PLC), for controlling various system components and sub-processors. The memory 162, coupled to the CPU 160, is non-transitory and is in the form of a computer-readable storage media containing instructions (e.g., non-volatile memory), that when executed by the CPU 160, facilitates the operation of the polishing system 100. The instructions in the memory 162 are in the form of a program product such as a program that implements the methods of the present disclosure. The program code may conform to any one of a number of different programming languages. In one example, the disclosure may be implemented as a program product stored on computer-readable storage media for use with a computer system. The program(s) of the program product define functions of the embodiments (including the methods described herein). Thus, the computer-readable storage media, when carrying computer-readable instructions that direct the functions of the methods described herein, are embodiments of the present disclosure.

Figure 2A:
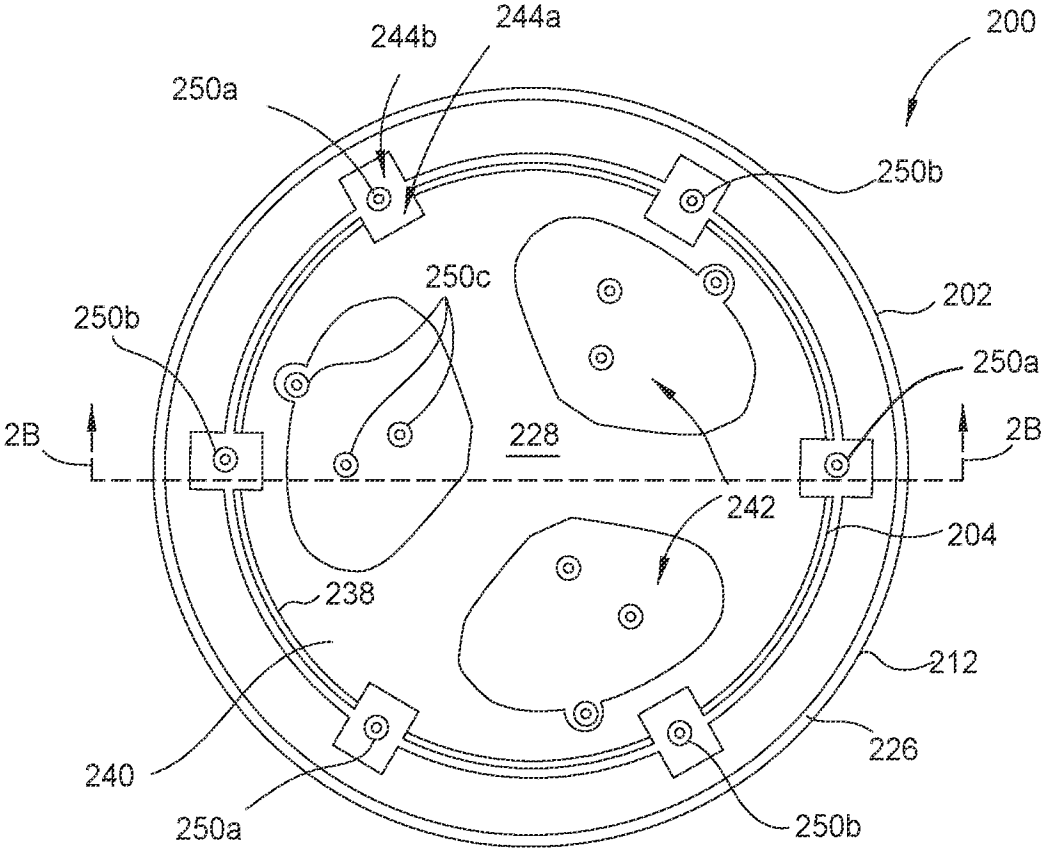
FIG. 2A is a schematic top down view of a loading station, according to one embodiment, which may be used with the polishing system of FIG. 1A.
Figure 2B:
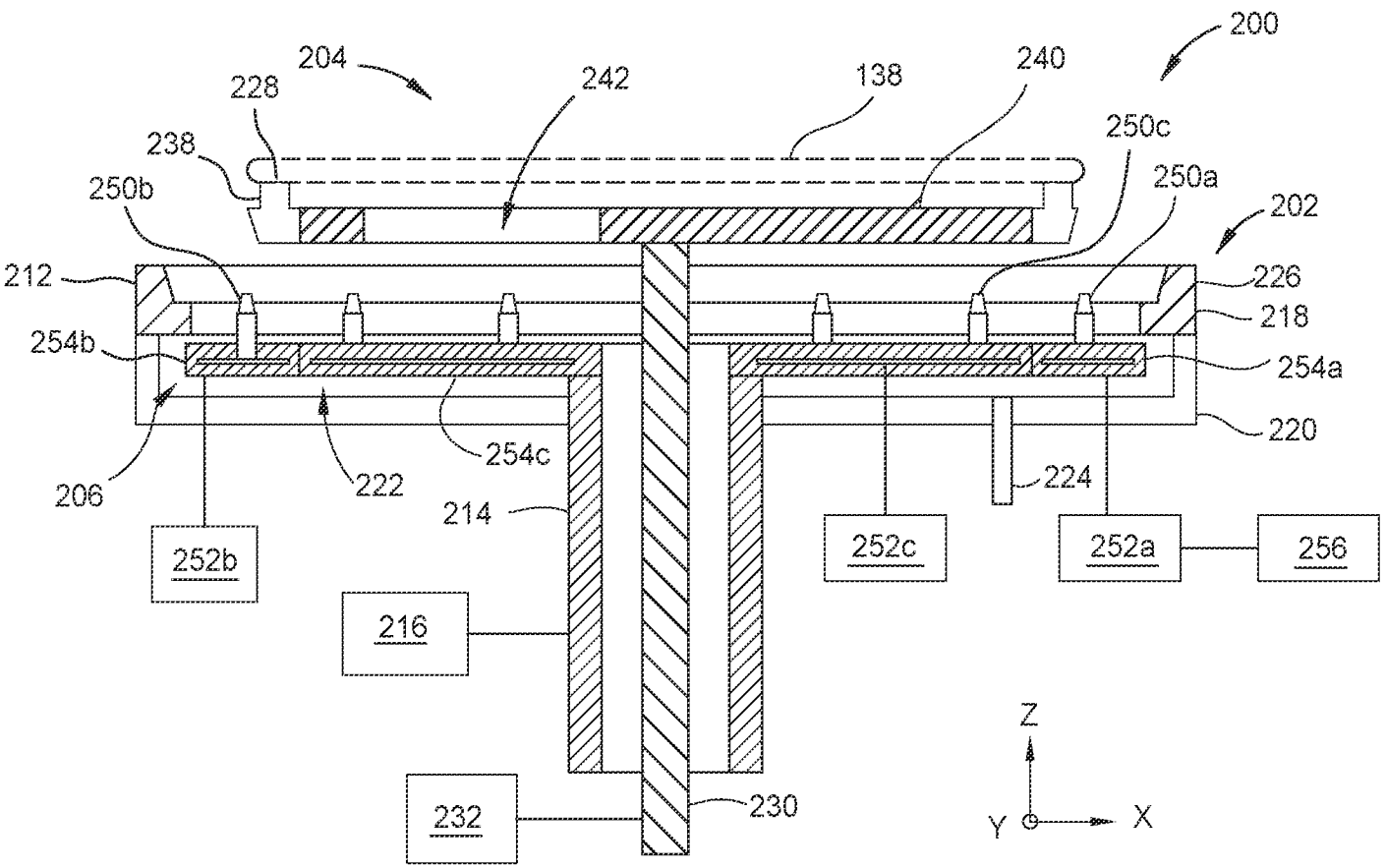
FIG. 2B is a schematic side view of the loading station shown in FIG. 2A taken along line 2B-2B.

FIG. 2A is a schematic top down view of a loading station 200, according to one embodiment, which may be used in place of the loading station 104 of FIG. 1A. FIG. 2B is a schematic sectional view of the loading station 200 taken along line 2B-2B of FIG. 2A. In order to reduce visual clutter, at least some of the features shown in FIG. 2A are not shown in FIG. 2B and vice versa.

The loading station 200 includes a cup assembly 202, a pedestal assembly 204, and a fluid delivery assembly 206. The cup assembly 202 includes a load cup 212 disposed on a first shaft 214 and an actuator 216 coupled to the first shaft 214 which is used to move the load cup 212 in the Z-direction, i.e., towards and away from a carrier head positioned thereover (not shown). The load cup 212 includes an annular upper portion 218 and a lower housing 220 which collectively define a basin 222 for collecting fluids used during the carrier and substrate cleaning methods set forth herein. Fluids are drained from the basin 222 using a drain 224 fluidly coupled thereto.

The upper portion 218 includes one or more carrier alignment features, here an annular lip 226, extending upwardly from an upward facing surface of the upper portion 218 and located proximate to the peripheral edge thereof. During transfer of a substrate (shown in phantom in FIG. 2B) to and from a carrier head (not shown), the load cup 212 is in a raised position and the annular lip 226 surrounds a portion of the outwardly facing surface of the carrier head to facilitate alignment between the carrier head and the load cup 212.

The pedestal assembly 204 includes a pedestal 228 disposed on a second shaft 230 and an actuator 232 coupled to the second shaft 230 which is used to move the pedestal in the Z-direction. The pedestal 228 has a generally circular shape when viewed from top down and an annular lip 238 disposed proximate to the circumferential edge of the pedestal 228 and extending upwardly therefrom. The annular lip 238 is sized and positioned to engage with the radially outermost portions of the active surface of a substrate 138, thus supporting the substrate 138 away from a recessed surface 240 of the pedestal 228 in order to minimize contact with, and to avoid the related scratching of, devices manufactured thereon.

The pedestal is movable in the Z-direction relative to the load cup 212 and may be extended upwardly therefrom and retracted thereinto to provide access to an end effector 114 (FIG. 1A) of a substrate handler 112 and to facilitate substrate loading and unloading from the carrier head positioned thereabove. Here, the pedestal 228 has a plurality of openings 242 disposed therethrough and a plurality of cutouts 244*a* disposed about a peripheral edge thereof. The upper portion 218 of the load cup 212 features a corresponding plurality of cutouts 244*b* formed in the radially inward facing surface thereof which are aligned with the plurality of cutouts 244*a* formed in the edge of the pedestal. The pluralities of openings 242 and cutouts 244*a,b* enable the fluid delivery assembly 206 disposed therebeneath to direct fluids towards desired surfaces of a carrier head (and/or a vacuum chucked substrate) positioned over the loading station 200 and aligned therewith.

The fluid delivery assembly 206 is fixedly coupled to the load cup 212 and includes a one or more first nozzles 250*a* (three shown), one or more second nozzles 250*b* (three shown), and a plurality of third nozzles 250*c*. The one or more first nozzles 250*a* and the one or more second nozzles 250*b* are aligned with the openings formed by the cutouts 244*a,b* (when viewed form top down). In some embodiments, the one or more first nozzles 250*a* and one or more second nozzles 250*b* are used to direct cleaning fluids towards an annular gap disposed between a flexible membrane and the retaining ring of a rotating carrier head to remove polishing byproducts therefrom.

The one or more first nozzles 250*a* are fluidly coupled to a first fluid source 252*a* and are positioned to direct a first fluid towards the circumferential edge of a substrate when the substrate is disposed in a rotating carrier head positioned over the loading station 200. The first fluid is used to dislodge undesired contaminants, such as nano-particles or micro-particles of dielectric material, from the bevel surfaces of the substrate prior to the polishing thereof. Examples of suitable fluids which may be used as the first fluid with the one or first nozzles 250*a* include deionized water (DIW), pressurized gases, e.g., nitrogen ($N_2$) or clean dry air (CDA), fluidized ice particles of DIW or carbon dioxide ($CO_2$) and/or solutions comprising such ice particles, and combinations thereof.

Here, the one or more first nozzles 250*a* are positioned to direct the first fluid towards the bevel edge of a substrate disposed in a rotating substrate carrier. The first fluid may be emitted from the one or more first nozzles 250*a* in a continuous or pulsed pressurized jet or stream and/or may be acoustically energized (e.g., via acoustic cavitation), pneumatically energized (e.g., using liquid mixed with a pressured gas), thermally energized (e.g., steam), or combination(s) thereof. In some embodiments, the one or more first nozzles 250*a* are fluidly coupled to the first fluid source 252*a* through a manifold 254*a* which distributes the first fluid therebetween.

Acoustically energizing the first fluid includes ultrasonic or megasonic energization of the first fluid. For example, one or both of the first nozzles 250*a* and the first fluid source 252*a* may be configured with an acoustic generator 256, e.g., a piezoelectric transducer, operable in a frequency range from a lower ultrasonic range (e.g., about 20 KHz) to an upper megasonic range (e.g., about 2 MHz). Other frequency ranges can also be used.

Pneumatically energizing the first fluid includes emitting different phase components from the one or more first nozzles 250*a*, such as one or more of a liquid and/or solid phase material, e.g., DIW, fluidized ice particles, and/or solutions comprising suspended ice particles, and a pressurized gas, such as $N_2$ or CDA. The different phase components may be combined in the first fluid source 252*a* or may be separately delivered to, and combined using, the one more first nozzles 250*a*. For example, in some embodiments, the one or more first nozzles 250*a* may be atomizer nozzles and the pressurized gas separately delivered thereto comprises an atomizing gas.

Thermally energizing the first fluid includes heating the first fluid to a vapor or gas phase, e.g., saturated or supersaturated steam. For example, in some embodiments the first fluid delivered to the one or more first nozzles 250*a* comprises water vapor or steam having a temperature in a range from about 80° C. to about 150° C., such as about 100° C. to about 120° C., at a pressure in the range from about 30 psig to about 140 psig, such as from about 40 psig to about 50 psig.

The one or more second nozzles 250*b* are fluidly coupled to a second fluid source 252*b* through a second manifold 254*b* which is used to distribute a second fluid between the one or more second nozzles. The one or more second nozzles are disposed in alignment with corresponding ones of the cutouts 244*a,b* (when viewed from top down) in an alternating arrangement with the one or more first nozzles 250*a* about peripheral edge of the pedestal 228. The one or more second nozzles 250*b* are positioned to direct the second fluid at the circumferential edge of a substrate disposed in a rotating carrier head that is aligned with the loading station 200 and positioned thereover. Typically, the second fluid 250*b* comprises a rinse solution, such as DIW, which is maintained close to ambient temperature or there below, such as about 40° C. or below, or in a range from about 20° C. to about 40° C. The second fluid emitted by the one or more second nozzles 250*b* may be used to rinse away contaminants dislodged by the energized first fluid and/or to cool the substrate edge and surfaces of the carrier head heated by the energized first fluid.

The plurality of third nozzles 250*c* are disposed radially inward (with respect to the load cup 212) of the one or more first nozzles 250*a* and the one or more second nozzles 250*b* and are aligned with the openings 242 (when viewed from top down). The plurality of third nozzles 250*c* are used to direct a third fluid towards the active surface of a substrate disposed in a rotating carrier head or towards the flexible membrane of a rotating carrier head between substrates. The plurality of third nozzles 250*c* are in fluid communication with a third fluid source 252*c* through a third manifold 254*c*. The third fluid is used to rinse the active surface of a substrate disposed in a rotating carrier head and/or the flexible membrane of a rotating carrier head before and/or after the polishing process. The third fluid may comprise cleaning solution and/or a rinse agent, such as DIW, delivered in combination or sequentially.

The nozzles 250*a-c* described herein are configured to deliver any one or combination of fluid spray patterns, such as flat fan, hollow cone, full cone, a solid stream, or combinations thereof. In some embodiments, one or both of the first nozzles 250*a* and the second nozzles 250*b* are configured to deliver a flat fan spray pattern.

Figure 3A:
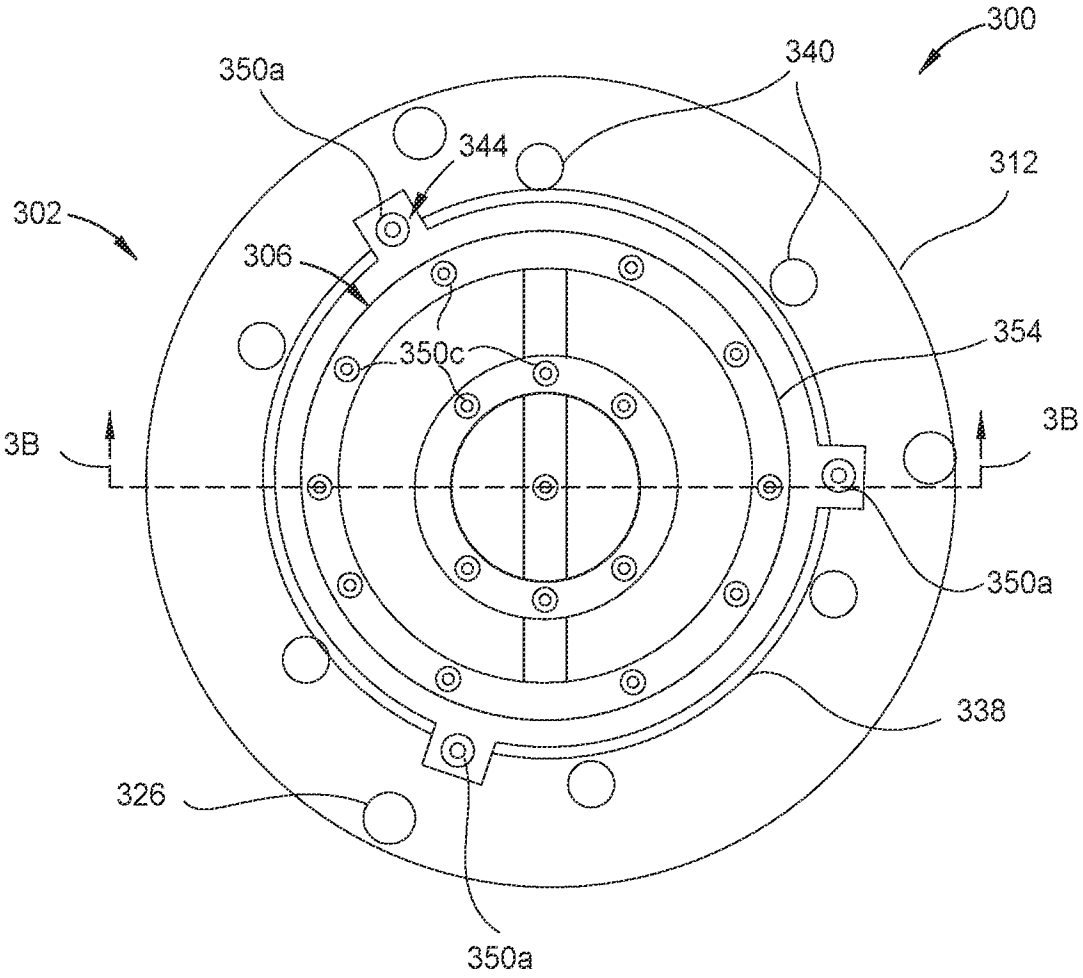
FIG. 3A is a schematic top down view of a loading station, according to another embodiment, which may be used with the polishing system of FIG. 1A.
Figure 3B:
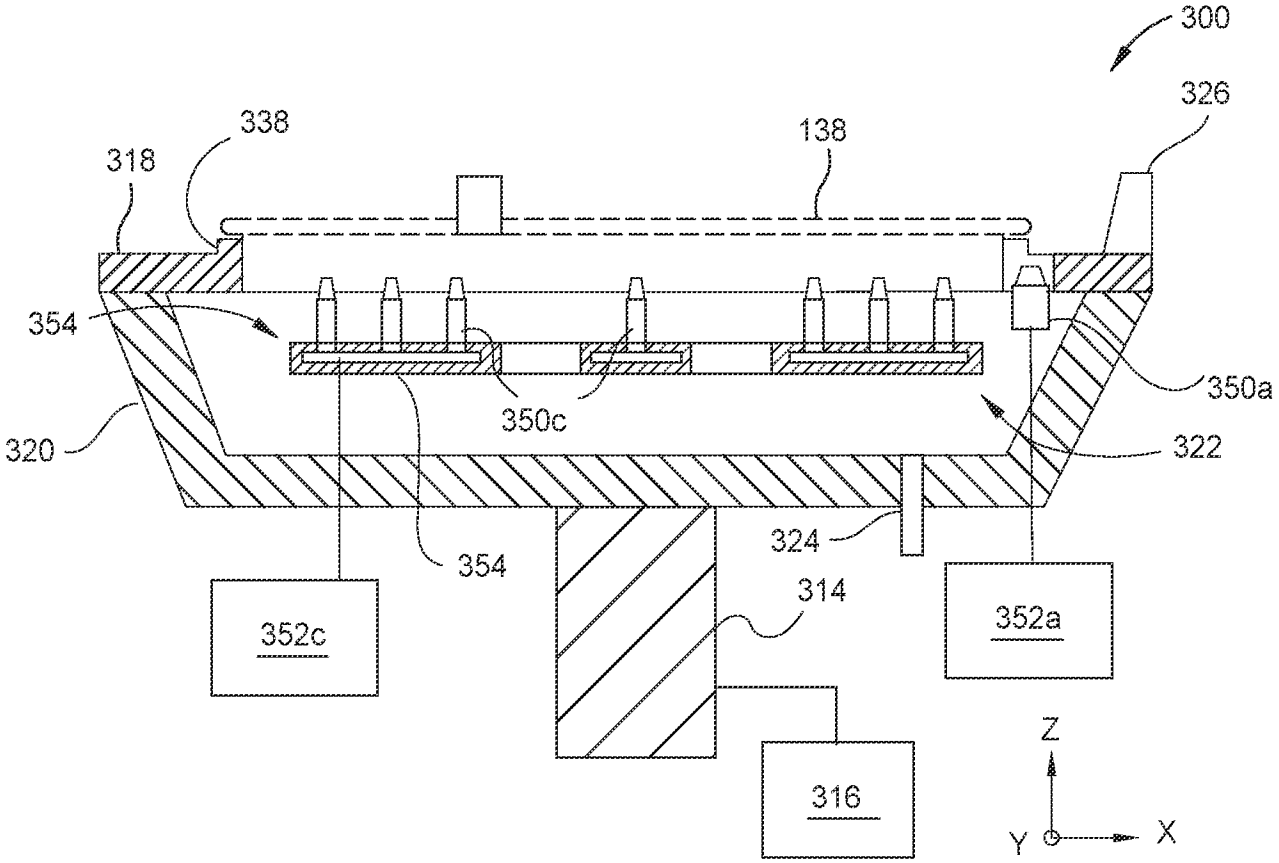
FIG. 3B is a schematic side view of the loading station shown in FIG. 3A taken along line 3B-3B.

FIG. 3A is a schematic top down view of a loading station 300, according to another embodiment, which may be used in place of the loading station 104 of FIG. 1A. FIG. 3B is a schematic sectional view of the loading station 300 taken along line 3B-3B of FIG. 3A. In order to reduce visual clutter, at least some of the features shown in FIG. 3A are not shown in FIG. 3B and vice versa.

The loading station 300 includes a cup assembly 302 and a fluid delivery assembly 306 disposed therein. The cup assembly 302 includes a load cup 312 disposed on a shaft 314 and an actuator 316 coupled to the shaft 314 which is used to move the load cup 312 in the Z-direction, i.e., towards and away from a carrier head positioned thereover (not shown). The load cup 312 includes an annular upper portion 318 and a lower housing 320 which collectively define a basin 322 for collecting fluids used during the carrier and substrate cleaning methods set forth herein. Fluids are drained from the basin 322 using a drain 324 fluidly coupled thereto.

The upper portion 318 includes a plurality of carrier alignment features 326, an annular lip 338 disposed proximate to the radially inward edge of the upper portion, and a plurality of substrate alignment features 340. The plurality of carrier alignment features 326 extend upwardly from an upward facing surface of the upper portion 318 and are spaced apart from one another at locations proximate to the peripheral edge thereof. During transfer of a substrate (shown in phantom in FIG. 3B) to and from a carrier head (not shown), the load cup 312 is in a raised position and the plurality of alignment features 326 contact the radially outward facing surface of the carrier head to facilitate alignment between the carrier head and the load cup 312.

The annular lip 338 is sized and positioned to engage with the radially outermost portions of the active surface of a substrate 138 (shown in phantom in FIG. 3B) in order to minimize contact with, and to avoid the related scratching of, devices manufactured thereon. The annular lip 338 extends upwardly from the upper portion 318 to space the substrate 138 apart from the surface thereof in order to facilitate transfer of the substrate to and from a carrier head (not shown) positioned over the loading station 300. The plurality of substrate alignment features 340 are disposed proximate to the annular lip 338 and radially outward therefrom and are used to center the substrate 138 on the annular lip 338 as the substrate 138 is received from a substrate handler 112. Typically, the plurality of substrate alignment features 340 retract into the load cup 312 during carrier loading and unloading so as not to interfere therewith.

The upper portion 318 of the load cup 312 features one or more cutouts 344 (three shown) formed in the radially inward facing surface thereof which are aligned with one or more edge cleaning nozzles 350*a* (when viewed from top down) of the fluid delivery assembly 306 disposed there below. The one or more edge clean nozzles 350*a* are fluidly coupled to a first fluid source 352*a* and are positioned to direct a first fluid towards the circumferential edge of a substrate when the substrate is disposed in a rotating carrier head positioned over the loading station 300. Here, the edge clean nozzles 350*a*, the first fluid source 352*a*, and the first fluid are substantially similar to the first nozzles 250*a*, the first fluid source 252*a*, and the first fluid described in FIGS. 2A-2B and may include any one or combination of the features thereof. In some embodiments, the fluid delivery assembly 306 further includes one or more second nozzles (not shown) fluidly coupled to a second fluid source (not shown) which may be substantially similar to the one or more second nozzles 250*b* fluidly coupled to the second fluid source 252*b* as shown and described in FIGS. 2A-2B.

Here, the fluid delivery assembly 306 further includes a plurality of third nozzles 350*c* which are disposed radially inward (with respect to the load cup 312) of the one or more edge clean nozzles 350*a*. The plurality of third nozzles 350*c* are used to direct a third fluid towards the active surface of a substrate disposed in a rotating carrier head or towards the flexible membrane of a rotating carrier head positioned thereover. The plurality of third nozzles 350*c* are in fluid communication with a third fluid source 352*c* through a manifold 354. The third nozzles 350*c*, the third fluid source 352*c*, and the third fluid are substantially similar to the third nozzles 250*c*, the third fluid source 252*c*, and the third fluid described in FIGS. 2A-2B and may include any one or combination of the features and/or properties thereof.

Figure 4:
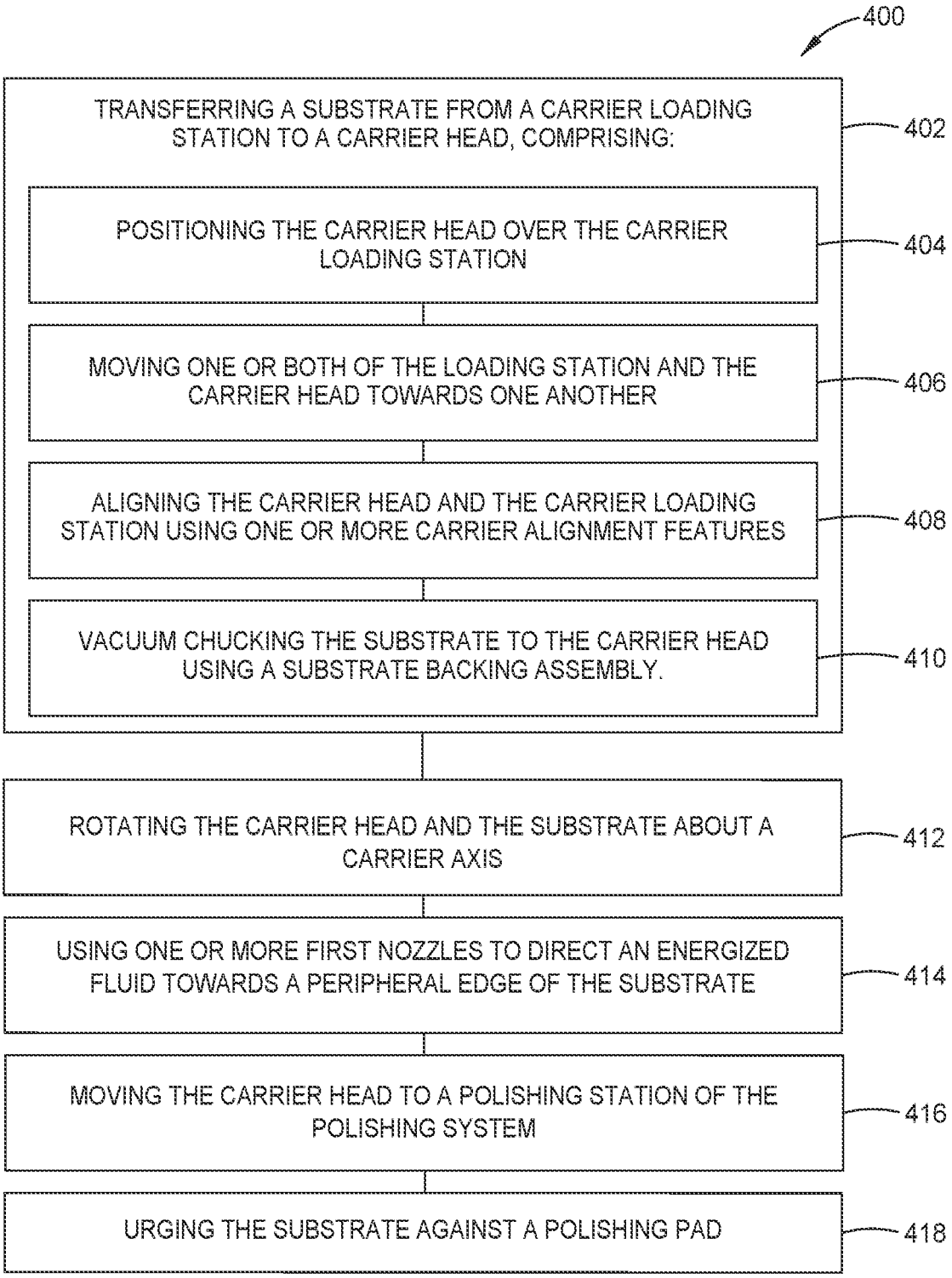
FIG. 4 is a diagram illustrating a method which may be used to remove contaminants from a bevel edge of a substrate, according to one embodiment.

FIG. 4 is a diagram illustrating a method 400 of cleaning the bevel edge of a substrate using the loading stations 200, 300 described herein.

At activity 402, the method 400 includes transferring a substrate 138 from a carrier loading station 104 of a polishing system 100 to a carrier head 130 positioned thereover. In some embodiments, transferring the substrate 138 includes positioning the carrier head 130 over the carrier loading station 104 at activity 404, moving one or both of the loading station 104 and the carrier head 130 towards one another at activity 406, aligning the carrier head 130 and the carrier loading station 104 at activity 408, and vacuum chucking the substrate 138 to the carrier head at activity 410.

At activity 412, the method 400 includes rotating the carrier head 130, and thus the substrate 138 vacuum chucked thereto, about a carrier axis B. Concurrently with activity 412, activity 414 of the method 400 includes using one or more first nozzles 250*a*, 350*a*, of the carrier loading station 104 to direct an energized fluid towards a peripheral edge of the substrate 138.

At activity 416, the method 400 includes moving the carrier head 130 to a polishing station 102. At activity 418, the method 400 includes urging the substrate against a polishing pad 118.

Figure 5A:
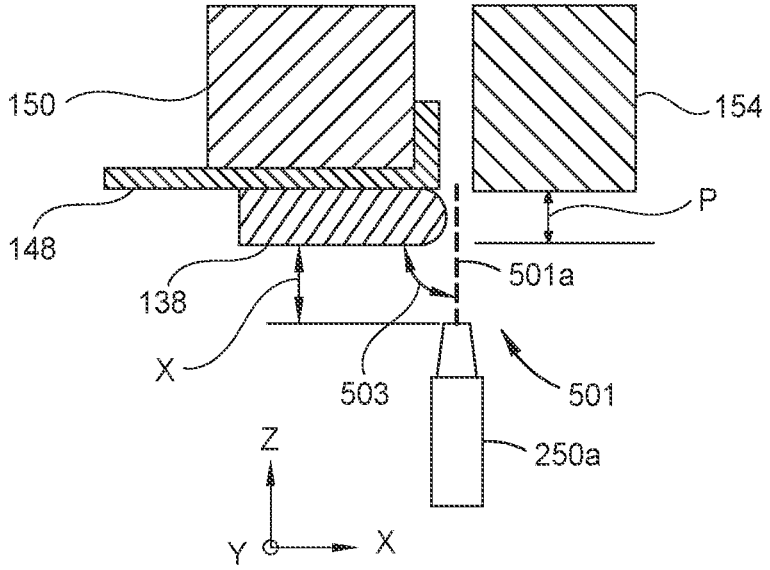
FIG. 5A schematically illustrates a relationship between a nozzle and a substrate edge during the method set forth in FIG. 4.

As schematically illustrated in FIG. 5A, the one or more first nozzles 250*a* and/or one or more second nozzles 250*b* (not shown) are positioned to direct an energized fluid 501 or a rinse fluids towards the peripheral edge of the substrate 138, e.g., the bevel edge. In some embodiments, one or more of the nozzles 250*a,b* are spaced apart from the substrate 138 (in the Z-direction) by a distance X of about 20 cm or less, such as about 15 cm or less.

Figure 5B:
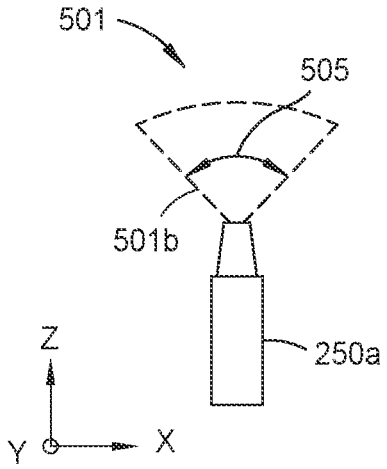
FIG. 5B illustrates a spray pattern of the nozzle shown in FIG. 5A.

In some embodiments, such as schematically illustrated in FIGS. 5A-5B, one or more of the first nozzles 250*a* and/or one or more of the second nozzles 250*b* (not shown) are configured to deliver a substantially flat fan-shaped spray pattern towards the peripheral edge of the substrate 138. Typically, in those embodiments, the nozzles 250*a* and or 250*b* are positioned so that a flat portion 501*a* (FIG. 5A) of the spray pattern is generally tangential to the circumferential edge of the substrate 132*e* and forms an angle 503 with the substrate surface of between about 60° and about 120°, i.e., within 30° of orthogonal, such as within 20° or orthogonal, such as within 10° of orthogonal to the substrate surface. Here, the fan shaped portion 501*b* (FIG. 1B) of the spray pattern forms an angle 505 of between about 60° and about 120°.

Beneficially, the carrier loading station and methods described above may be used to remove nano-scale and/or micron-scale particles adhered to a bevel edge of a substrate before polishing of the substrate. By removing such contaminates from the bevel edge, such as loosely adhered particles of dielectric material, contamination of the polishing interface can be avoided thus preventing and/or substantially reducing scratch related defectivity associated therewith.

While the foregoing is directed to embodiments of the present disclosure, other and further embodiments of the disclosure may be devised without departing from the basic scope thereof, and the scope thereof is determined by the claims that follow.

The invention claimed is:

1. A polishing system, comprising:

a carrier loading station comprising:

one or more support surfaces for supporting a to-be-polished substrate, wherein the one or more support surfaces are sized and located to engage with radially outermost portions of an active surface of the to-be-polished substrate;

a load cup;

a carrier head comprising a substrate backing assembly and an annular retaining ring surrounding the substrate backing assembly; and a fluid delivery assembly directly fixed to the load cup, the fluid delivery assembly comprising one or more first nozzles configured to spray energized fluids in a fan shaped spray pattern having a flat portion directed towards an annular gap formed between the substrate backing assembly and the annular retaining ring when the carrier head is disposed over the carrier loading station and is aligned therewith, wherein the flat portion of the fan shaped spray pattern is tangential to a peripheral edge of the to-be-polished substrate when the to-be-polished substrate is vacuum chucked to the carrier head positioned over the carrier loading station and aligned therewith, wherein the energized fluids comprise acoustically energized fluid, liquid mixed with a pressured gas, thermally energized fluid, or a combination thereof.

2. The polishing system of claim 1, wherein the one or more first nozzles are disposed proximate to the one or more support surfaces when the carrier loading station is viewed from top down.

3. The polishing system of claim 1, wherein the one or more first nozzles are atomizer nozzles.

4. The polishing system of claim 1, wherein the one or more first nozzles are positioned so that the flat portion of the fan shaped spray pattern is within 20° of orthogonal to the active surface of the to-be-polished substrate.

5. The polishing system of claim 1, wherein the one or more first nozzles are fluidly coupled to a first fluid source configured to deliver the energized fluids to the one or more first nozzles.

6. The polishing system of claim 1, further comprising a non-transitory computer readable medium having instructions stored thereon for performing a method of processing a substrate when executed by a processor, the method comprising:

transferring the substrate from the carrier loading station to the carrier head, wherein the carrier head is positioned over the carrier loading station and is aligned therewith;

rotating the carrier head and the substrate about a carrier axis;

using the one or more first nozzles to direct the energized fluid towards the peripheral edge of the substrate as the carrier head rotates the substrate about the carrier axis;

moving the carrier head to a polishing station of the polishing system; and urging the substrate against a polishing pad.

7. The polishing system of claim 6, wherein transferring the substrate to the carrier head comprises:

positioning the carrier head over the carrier loading station, wherein the substrate is disposed on the one or more support surfaces of the carrier loading station;

moving one or both of the carrier loading station and the carrier head towards one another;

aligning the carrier head and the carrier loading station using one or more carrier alignment features extending upwardly from the carrier loading station; and vacuum chucking the substrate to the carrier head using the substrate backing assembly.

8. The polishing system of claim 6, wherein the one or more first nozzles are spaced apart from the substrate by a distance of 20 cm or less as the energized fluid is directed towards the peripheral edge thereof.

9. The polishing system of claim 6, wherein the fluid delivery assembly further comprises one or more second nozzles fluidly coupled to a second fluid source, wherein the one or more second nozzles are positioned to direct a rinsing fluid from the second fluid source towards the peripheral edge of the substrate as the carrier head rotates about the carrier axis.

10. The polishing system of claim 6, wherein the substrate backing assembly is surrounded by the annular retaining ring, and a surface of the vacuum chucked substrate protrudes outwardly from the annular retaining ring as the energized fluid from the one or more first nozzles is directed towards the peripheral edge of the substrate.

11. A method of processing a substrate, comprising:

transferring a substrate from a carrier loading station of a polishing system to a carrier head positioned over the carrier loading station and aligned therewith;

rotating the carrier head and the substrate about a carrier axis;

using one or more first nozzles directly fixed to the carrier loading station to spray an energized fluid in a fan shaped spray pattern having a flat portion directed towards an annular gap formed between a substrate backing assembly and an annular retaining ring when the carrier head is disposed over the carrier loading station and is aligned therewith, the flat portion of the fan shaped spray pattern being tangential to a peripheral edge of the substrate as the carrier head rotates the substrate about the carrier axis, wherein the energized fluid comprises acoustically energized fluid, liquid mixed with a pressured gas, thermally energized fluid, or a combination thereof;

moving the carrier head to a polishing station of the polishing system; and urging the substrate against a polishing pad.

12. The method of claim 11, wherein transferring the substrate to the carrier head comprises:

positioning the carrier head over the carrier loading station, wherein the substrate is disposed on a surface of the carrier loading station;

moving one or both of the carrier loading station and the carrier head towards one another;

aligning the carrier head and the carrier loading station using one or more carrier alignment features extending upwardly from the carrier loading station; and vacuum chucking the substrate to the carrier head using a substrate backing assembly.

13. The method of claim 12, wherein the one or more first nozzles are spaced apart from the substrate by a distance of 20 cm or less as the energized fluid is directed towards the peripheral edge thereof.

14. The method of claim 11, further comprising using one or more second nozzles of the carrier loading station to direct a rinsing fluid at the peripheral edge of the substrate as the carrier head rotates about the carrier axis.

15. The method of claim 11, wherein the energized fluid from the one or more first nozzles is acoustically energized, pneumatically energized, thermally energized, or a combination thereof.

16. The method of claim 15, wherein the one or more first nozzles are atomizer nozzles.

17. The method of claim 12, wherein the substrate backing assembly is surrounded by the retaining ring, and a surface of the vacuum chucked substrate protrudes outwardly from the retaining ring as the energized fluid from the one or more first nozzles is directed towards the peripheral edge of the substrate.

* * * * *